US005904091A

United States Patent [19]

Arai

[11] Patent Number: 5,904,091

[45] Date of Patent: May 18, 1999

[54] PICTURE ENGRAVING METHOD AND ENGRAVED PICTURE BEARING CERTIFICATE

[75] Inventor: Hiroshi Arai, Tokyo, Japan

[73] Assignee: EPC Corporation, Saitama-Ken, Japan

[21] Appl. No.: 08/741,680

[22] Filed: Oct. 31, 1996

[30] Foreign Application Priority Data

May 17, 1996 [JP] Japan ..... 8-148327

[51] Int. Cl.[6] ..... B31F 1/07

[52] U.S. Cl. ..... 101/32; 101/3.1; 358/297

[58] Field of Search ..... 283/87; 358/297; 101/3.1, 32

[56] References Cited

U.S. PATENT DOCUMENTS 4,021,605 5/1977 Tauszig ..... 258/297
5,284,364 2/1994 Jain ..... 283/87

*Primary Examiner*—Edgar Burr
*Assistant Examiner*—Charles H Nolan, Jr.
*Attorney, Agent, or Firm*—Hoffmann & Baron, LLP

[57] ABSTRACT

An engraved picture bearing certificate comprising a specular-surfaced engraving sheet on which an original picture for identification, such as the photograph of face, a fingerprint, a signature, a logo or the like, is engraved by a graving tool of an engraving device. The specularly reflected light from the surface of the engraving sheet is visibly recognized as the engraved picture.

6 Claims, 2 Drawing Sheets

PICTURE ENGRAVING METHOD AND ENGRAVED PICTURE BEARING CERTIFICATE

BACKGROUND OF THE INVENTION

1. Field of the Invention

The present invention relates to a picture engraving method in which a picture is engraved by a graving tool in response a picture signal that is picked up when an original picture is scanned, and also relates to a certificate with an engraved picture of a photograph of face, a fingerprint, a signature, a logo and the like, such as an identity card, a security and the like.

2. Description of the Related Art

A picture engraved on a dark opaque thin sheet and presented in shades of gray may be used for a personal identification. Such an engraved picture is hard to alter or counterfeit compared with an ordinary picture. However, the engraved picture can be tampered with black ink and thus, still needs careful inspection before judging genuineness. Japanese Unexamined Patent Publication No. 52-29221 discloses a genuineness determination method in which parallel light beams are projected from a certain angle to an engraved picture that is made by engraving a picture on a opaque thin sheet using a sharp-pyramid-like pointed graving tool and only reflected light beams having a characteristic directivity corresponding to the angle of the graving tool are searched. Furthermore, Japanese Unexamined Patent Publication No. 6-15794 discloses an engraving sheet made of an engraved non-light-transmissive film and a light-transmissive film.

In the first disclosure above, the shape of the graving tool should satisfy a predetermined requirement, and a special device is needed to verify a visual observation angle. In the second disclosure, an identical picture may be obtained by peeling off the non-light-transmissive film, applying white ink, and forming its negative. In such an engraving method, the back side of the sheet available for printing is narrowed.

SUMMARY OF THE INVENTION

Accordingly, it is an object of the present invention to provide an engraving method that produces a picture hard to alter or counterfeit using a simple organization based on visual observation of reflected light. It is another object of the present invention to provide an engraved picture bearing certificate for identification hard to alter or counterfeit.

To achieve the above objects, the engraving method of the present invention of driving a graving tool of a picture engraving device in response to a picture signal that is picked up through the scanning of an original picture, comprises the step of engraving an engraving sheet having a specular surface, according to the picture signal from a negative of the original picture so that the specularly reflected light from the surface of the engraving sheet is visibly recognized as an engraved picture.

The graving tool incises the engraved picture relatively more deeply in a dark portion than in a light portion of the original picture, according to the picture signal of the negative. When parallel light beams are obliquely projected to the engraved picture, engraved portions reflect the light beams at an angle corresponding to the inclination of each point of reflection. Non-engraved portions specularly reflect light in parallel beams, and are visibly observed in that reflected direction.

According to the method of this invention, the engraved picture cannot be visibly recognized if viewed simply from the front. Under parallel beams, a visible engraved picture is obtained at a predetermined tilt angle. The altered or counterfeited engraved picture made using photographic transfer or a copying machine is easily found. An attempt to alter using an ink layer encounters much more difficulty compared with the known engraved picture, because the formation of a specular surface is generally difficult.

An original picture for identification purpose is engraved using an ordinary engraving device according to the inverted form of a monochrome picture signal as a picture signal, and thus a highly reliable engraved picture of a person or a logo for identification is easily obtained.

The present invention offers ID cards, credit cards, passports, securities and the like which carry engraved pictures hard to alter or counterfeit, including a photograph of face, a fingerprint, a signature and a logo. The counterfeit of using color copying is impossible. By transferring a color photograph of face along with an engraved picture of face, the genuineness of the photograph of face is checked and verification of identity is performed even more reliably. By engraving the logo of an issuer, a security hard to counterfeit is issued.

DETAILED DESCRIPTION OF THE PREFERRED EMBODIMENTS

Figure 1:
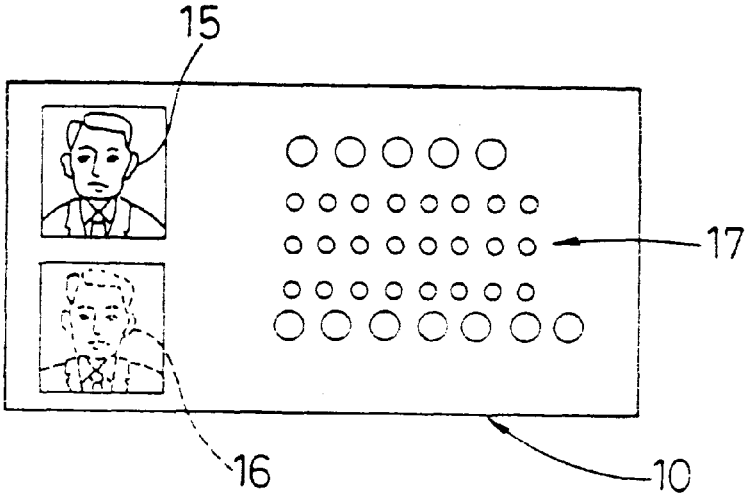
FIG. 1 is a front view showing an identity card that is produced by embodying the engraving method of the present invention.
Figure 2:
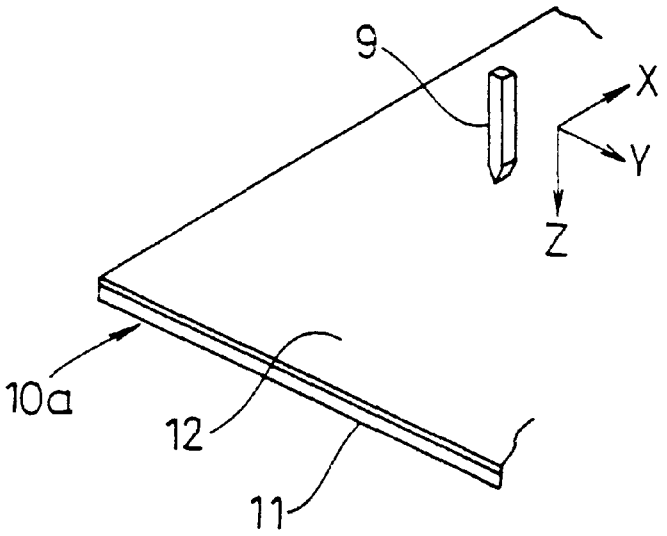
FIG. 2 is a perspective view of the engraving sheet of the identity card.

Referring to FIGS. 1 and 2, there is discussed the identity card in which the engraving method of the present invention is embodied as an engraved picture bearing certificate. Referring to FIG. 2, an identity card 10 is formed by cutting an engraving sheet 10*a* by the size of the card. The engraving sheet 10*a* is a laminate made of a synthetic resin substrate 11 and an engraving layer 12 overlying the resin substrate 11. The engraving layer 12 is formed by printing a silver of 8 $\mu$m thick, smooth-surfaced film. The color photograph of face of an individual is thermo-transferred to the engraving layer 12 having a specular surface. Likewise, characters 17 for identification are printed through thermo-transfer technique. Engraved below the photograph of face 15 is an engraved picture 16 of the photograph of face.

The engrave input signal for an engraving device is the picture signal of the negative that is obtained by picking up a monochrome picture signal by scanning the color photograph of face 15 linearly line by line and then by inverting the monochrome picture signal. As shown in FIG. 2, the graving tool 9 scans linearly in the direction of X axis, while shifting in the direction of Y axis sequentially line by line at each completion of linear scanning in the X axis and being driven in the direction of Z axis according to the amplitude of engrave input signal, namely the graving tool 9 is driven in three mutually perpendicular directions. The engraving layer 12 is incised by the graving tool 9 having a triangular shape in cross section. The lighter the negative is, the more deeply the engraving layer 12 is incised. Dark portions of the negative are shallowly incised, and the periphery of the dark portions remains specular. Thus, the positive of the photograph of face is engraved as the picture 16.

Figure 3A:
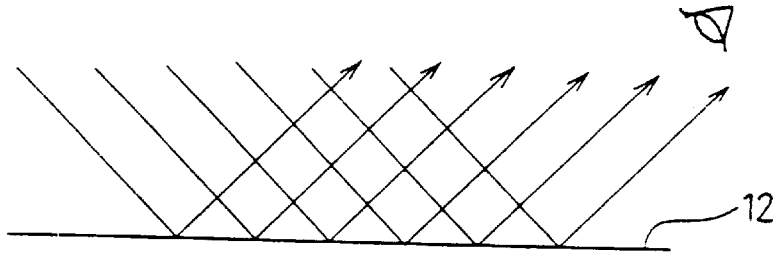
FIG. 3A and 3B illustrate the principle of the engraved picture of the identity card.
Figure 3B:
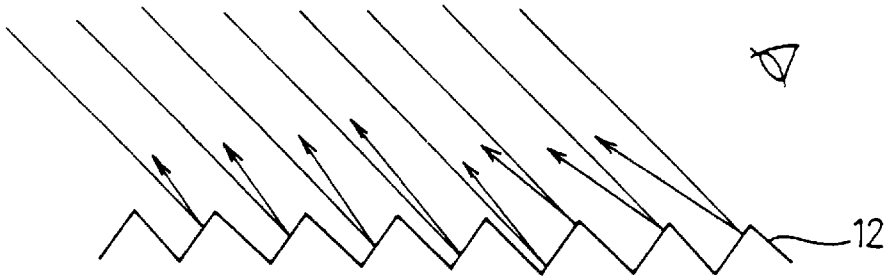

To run identity check of an individual with his or her identity card 10, the individual is first checked against the photograph of face 15, and then light beams from a particular light source, for example, a particular fluorescent lamp, spaced apart by some distance are obliquely projected to the identity card 10 so that a checker can observe specularly reflected light in substantially parallel conditions from the surface of the identity card 10. Portions of the engraving layer 12 corresponding to the dark portions of the photograph of face 15 is deeply incised, causing no specular reflection (refer to FIG. 3B). As the photograph of face 15 gets lighter, the depth of incision gets shallower; the quantity of specular reflection from surrounding specular portions increases accordingly (FIG. 3A) and the quantity of incident light to the eyes increases gradually. Thus, the engraved picture corresponding to the photograph of face 15 is visibly recognized, and allows the checker to verify the genuineness of the photograph of face 15.

In the ordinary engraved picture in which the incision of the black layer determines the degree of exposure of a substrate, namely, the shade of gray of the picture, the checker has difficulty telling the difference between the engraved picture and an ordinary monochrome picture, and the difference is even less noticeable to the human naked eye as the resolution is better, and the counterfeiting of the engraved picture using photographic transfer is thus relatively easy. In contrast, the engraved picture of the present invention cannot be visibly recognized at a glance. By gradually changing the tilt angle of the engraved picture with respect to parallel incident light beams so that they are obliquely projected to the engraved picture, the checker can visibly recognize the engraved picture at a particular tilt angle as a mirage image. Thus, the counterfeiting of the engraved picture using the photographic transfer technique is impossible. Furthermore, the use of specular reflection makes it impossible for one to alter the engraved picture by tampering with it with ink application.

The present invention finds personal identity applications not only in the above-described identity card but also in passports, credit cards and the like. As an example of an engraved picture bearing certificate, a security hard to counterfeit through color copying may be issued. The security may bear required piece of information printed and the logo of an issuer engraved on the engraving sheet. Used as the engrave input signal for the engraving device is an inverted form of a picture signal taken from the logo or the picture signal of the negative of the logo.

An engraving sheet may be produced by overlaying an engraving layer of gold, aluminum or the like over a substrate so that the surface of the substrate becomes specular. Alternatively, a single-layered synthetic resin sheet having a specular surface finish and without a substrate beneath may be perfectly acceptable as an engraving sheet. In this case, the synthetic resin has preferably a large reflectance so as to increase the quantity of reflecton. The pointed graving tool is not limited to the one having the isosceles triangle in cross section. Any graving tool is acceptable as long as it incise a smaller area as the level of the picture signal of the negative gets lower.

What is claimed is:

1. A method of providing an engraved picture bearing certificate, comprising:

providing an engraving sheet having a specular surface;

scanning a photograph of an image to provide a picture signal;

driving a graving tool in response to said signal to incise said image in said engraving sheet by mechanical action only whereby said engraved image cannot be visibly recognized when directly viewing said engraving sheet.

2. The method according to claim 1, further comprising the steps of:

projecting parallel light beams at an oblique angle against the surface of said engraving sheet and simultaneously viewing said engraving surface at a particular tilt angle to identify said engraved image; and verifying the authenticity of said certificate by comparing said engraved image with a control image.

3. The method according to claim 2, wherein said scanning step includes the further step of inverting said picture signal.

4. The method according to claim 2, wherein said providing step includes the further step of laminating an engraving layer having a specular surface to a substrate.

5. The method according to claim 2, wherein said driving step includes the further steps of deeply incising dark portions of said photograph in said engraving layer and shallowly incising light portions of said photograph in said engraving layer.

6. The method according to claim 2, further comprising the step of thermotransferring said photograph to said engraving sheet.

* * * * *